US007371295B2

(12) United States Patent
Oikawa et al.

(10) Patent No.: US 7,371,295 B2
(45) Date of Patent: May 13, 2008

(54) SHAPE MEMORY ALLOY AND METHOD FOR PRODUCING SAME

(75) Inventors: Katsunari Oikawa, Shibata-gun (JP); Kiyohito Ishida, 15-41-503, Ichibancho 1-chome, Aoba-ku, Sendai-shi, Miyagi-ken (JP); Ryosuke Kainuma, Natori (JP); Yuuki Tanaka, Sendai (JP); Masahiro Ohta, Wako (JP); Toru Sukigara, Wako (JP)

(73) Assignees: Honda Motor Co., Ltd., Tokyo (JP); Kiyohito Ishida, Fukuoka (JP); National Institute of Advanced Industrial Science & Technology, Tokyo (JP)

( * ) Notice: Subject to any disclaimer, the term of this patent is extended or adjusted under 35 U.S.C. 154(b) by 265 days.

(21) Appl. No.: 10/804,244

(22) Filed: Mar. 18, 2004

(65) Prior Publication Data

US 2005/0016642 A1 Jan. 27, 2005

(30) Foreign Application Priority Data

Mar. 18, 2003 (JP) ..... 2003-074502

(51) Int. Cl.
*C22C 30/00* (2006.01)

(52) U.S. Cl. ..... 148/402; 148/442; 420/580

(58) Field of Classification Search ..... 148/402
See application file for complete search history.

(56) References Cited

U.S. PATENT DOCUMENTS 4,205,293 A * 5/1980 Melton et al. ..... 337/140

FOREIGN PATENT DOCUMENTS

| | | | |
|---|---|---|---|
| JP | 61-106746 | * | 5/1986 |
| JP | 3-257141 | * | 11/1991 |
| JP | 05-311287 | | 11/1993 |
| JP | 11-509368 A1 | | 8/1999 |
| JP | 11-269611 | | 10/1999 |
| JP | 2001-329347 | | 11/2001 |
| JP | 2002-129273 | * | 5/2002 |
| JP | 2002-317235 | | 10/2002 |
| WO | WO-97/03472 A2 | | 1/1997 |

OTHER PUBLICATIONS

Oikawa K. et al: "Promising Ferromagnetic Ni-Co-Al Shape Memory Alloy System" Applied Physics Letters, American Institute of Physicals. New York, US, vol. 79. No. 20, Nov. 12, 2001, pp. 3290-3292, XP001102895 ISSN: 0003-6951.

* cited by examiner

*Primary Examiner*—George P. Wyszomierski
(74) *Attorney, Agent, or Firm*—Lahive & Cockfield, LLP; Anthony A. Laurentano, Esq.

(57) ABSTRACT

A shape memory alloy comprises Co, Ni and Al with a two-phase structure comprising a β-phase having a B2 structure and a γ-phase having an fcc structure, at least 40% by area of crystal grain boundaries of the β-phase being occupied by the γ-phase. The shape memory alloy can be produced by a first heat treatment step comprising heating at 1200 to 1350° C. for 0.1 to 50 hours and cooling at 0.1 to 1000° C./minute, and a second heat treatment step comprising heating at 1000 to 1320° C. for 0.1 to 50 hours and cooling at 10 to 10000° C./minute.

5 Claims, 4 Drawing Sheets

SHAPE MEMORY ALLOY AND METHOD FOR PRODUCING SAME

FIELD OF THE INVENTION

The present invention relates to a shape memory alloy excellent in mechanical strength, workability and a shape recovery ratio, and a method for producing such a shape memory alloy.

BACKGROUND OF THE INVENTION

In the fields of robots, working machines, automobiles, etc. using electromagnetic motors, the weight reduction of drive systems has been demanded. However, because the output densities of the electromagnetic motors depend on their weight, only limited weight reduction is available in actuators using the electromagnetic motors. It has been thus desired to develop a small-sized, lightweight actuator capable of providing high output.

Actuators should satisfy the following conditions: moving parts are displaced to desired positions by a driving force; the moving parts are surely returned to start positions in a nonoperative state; sufficiently large output is provided such that moving parts can move even with a large load; etc. Springs are used as pressure-controlling members to bring the moving parts back to the start positions in a nonoperative state. In a case where a spring has large resiliency, a large driving force is needed to move the moving part against a spring force. It is thus desired to provide a spring displaced by a slight force.

Shape memory alloys have particularly attracted much attention as materials for actuators, because they can be strained as much as about 5% (shape recovery strain). The shape memory alloys are materials that can be returned to their original shapes at transformation temperatures or higher after deformed at certain temperatures. When a shape memory alloy having an austenitic phase, a high-temperature phase, is heat-treated with its shape constrained to memorize the shape, deformed in a martensitic phase, a low-temperature phase, and then heated, it returns to its original shape through a reverse transformation mechanism. This phenomenon is utilized for actuators. However, the shape recovery phenomenon by temperature change needs control by heating and cooling, and particularly thermal diffusion by cooling is a rate-determining step, resulting in low response to temperature control.

Ferromagnetic shape memory alloys excellent in a shape memory response speed have recently attracted much attention as novel materials for actuators. The ferromagnetic shape memory alloys have a phase transition structure (a twin crystal structure). When a magnetic field is applied to the ferromagnetic shape memory alloys, the martensitic unit cells (magnetization vectors in the cells) are reoriented along a magnetic field to induce strain. JP 11-269611 A discloses an iron-based, magnetic shape memory material composed of an Fe—Pd or Fe—Pt alloy, which is subjected to martensitic transformation by the application of a magnetic energy to generate magnetic strain. However, the iron-based magnetic shape memory alloys such as the Fe—Pd alloy and the Fe—Pt alloy have low ductility and thus low workability and mechanical strength as well as economic disadvantage because of high material costs. JP 5-311287 A discloses a Cu-based ferromagnetic shape memory alloy obtained by sintering a compacted mixture of Cu—Al alloy powder and Cu—Al—Mn alloy powder. However, because this Cu-based ferromagnetic shape memory alloy is produced by compacting, sintering and working powder materials, it disadvantageously has low workability and mechanical strength. Further, JP 11-509368 A and JP 2001-329347 A disclose magnetically driven actuators formed by Ni—Mn—Ga alloys. However, the Ni—Mn—Ga alloys are disadvantageous in workability, mechanical strength and repeating characteristics.

Ferromagnetic shape memory Ni—Co—Al alloys having excellent workability and shape recovery ratio and capable of being subjected to martensitic transformation have recently been proposed (see, for instance, JP 2002-129273 A). However, JP 2002-129273 A is silent about their mechanical strength.

OBJECTS OF THE INVENTION

Accordingly, an object of the present invention is to provide a shape memory alloy having high mechanical strength and excellent workability and shape recovery ratio, which undergoes martensitic transformation.

Another object of the present invention is to provide a method for producing such a shape memory alloy.

SUMMARY OF THE INVENTION

As a result of intense research in view of the above objects, the inventors have found that a shape memory alloy having at least two phases can be turned to a shape memory alloy having high mechanical strength and excellent shape recovery ratio, which undergoes martensitic transformation, by controlling its microstructure comprising a main phase (β-phase) and a sub-phase (γ-phase). The present invention has been accomplished by this finding.

Thus, the shape memory alloy of the present invention comprises Co, Ni and Al, and has a two-phase structure comprising a β-phase having a B2 structure and a γ-phase having an fcc structure, at least 40% by area of crystal grain boundaries of the β-phase being occupied by the γ-phase.

45 to 80% by area of the crystal grain boundaries of the β-phase are preferably occupied by the γ-phase. Namely, the area ratio of the γ-phase existing in the β-phase grain boundaries (hereinafter referred to as "γ-phase area ratio") is preferably 45 to 80%. The volume ratio of the γ-phase in the shape memory alloy is preferably 5 to 50%. The shape memory alloy preferably comprises 20 to 50 atomic % of Co and 22 to 30 atomic % of Al. The shape memory alloy can be provided with excellent mechanical strength and shape recovery ratio by controlling the average grain size of the β-phase and the volume ratio of the γ-phase.

The shape memory alloy comprising a γ-phase occupying at least 40% by area of the crystal grain boundaries of a β-phase can be produced by heat treatment comprising a first step comprising heating at 1200 to 1350° C. for 0.1 to 50 hours and cooling at 0.1 to 1000° C./minute, and a second step comprising heating at 1000 to 1320° C. for 0.1 to 50 hours and cooling at 10 to 10000° C./minute.

DETAILED DESCRIPTION OF THE PREFERRED EMBODIMENTS

The shape memory alloy of the present invention comprises Co, Ni and Al, and has a two-phase structure comprising a β-phase having a B2 structure undergoing martensitic transformation, and a γ-phase having an fcc structure rich in ductility. At least 40% by area of the β-phase grain boundaries are occupied by the γ-phase. In the two-phase structure comprising a γ-phase and a β-phase, the γ-phase strengthens the crystal grain boundaries of the β-phase to prevent failure in the grain boundaries, which would occur if the alloy were composed only of a β-single phase, thereby improving the ductility of the alloy. Further, by covering at least 40% by area of the β-phase grain boundaries with the γ-phase, brittle crystal grain boundaries between the β-phase grains decrease, resulting in increase in the mechanical strength of the alloy. The γ-phase area ratio is represented by a ratio (%) of the total length of γ-phase grains existing in β-phase grain boundaries to the total length of the β-phase grain boundaries, in an arbitrary cross section of the alloy.

The magnetism of the Ni—Co—Al alloy depends on the percentages of constituent elements. The alloy is lower in magnetism when it has a higher Al content, and ferromagnetic when it has a higher Co or Ni content. The β-phase of the shape memory alloy may be ferromagnetic or paramagnetic.

Figure 1:
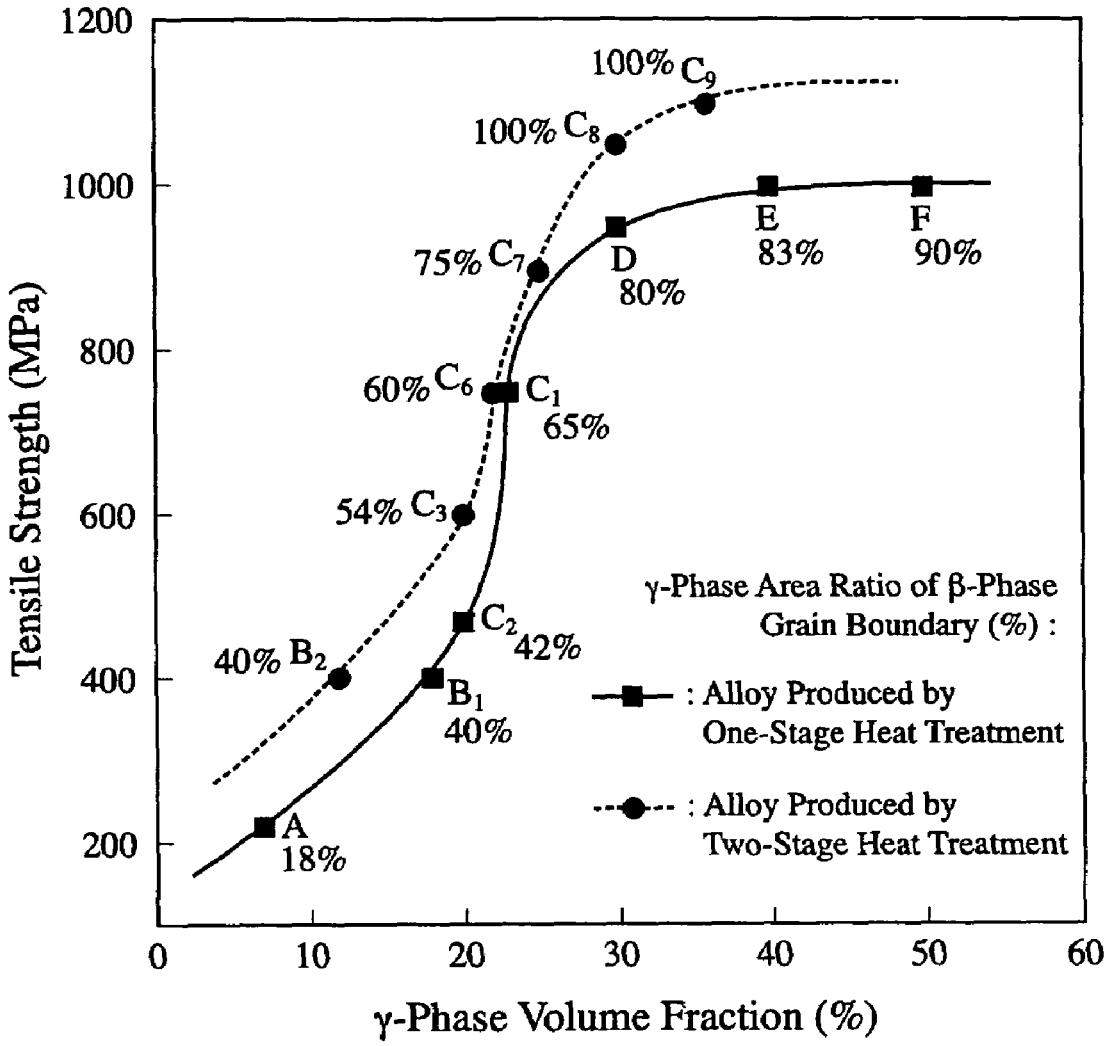
FIG. 1 is a graph showing the relation of tensile strength to a γ-phase volume fraction and a γ-phase area ratio in shape memory alloys produced by a one-stage heat treatment and a two-stage heat treatment, respectively.

FIG. 1 shows the relation of tensile strength to a γ-phase area ratio and a γ-phase volume fraction in shape memory alloys produced by a one-stage heat treatment and a two-stage heat treatment, respectively. As shown in FIG. 1, the area ratio of the γ-phase existing in the β-phase grain boundaries increases as the γ-phase volume fraction increases in an alloy produced by any heat treatment. The mechanical strength (tensile strength) of the Ni—Co—Al alloy depends on the area ratio and volume fraction of the γ-phase existing in the β-phase grain boundaries. The mechanical strength of the alloy is lowered as the volume fraction or area ratio of the γ-phase decreases, and becomes higher as the volume fraction or area ratio of the γ-phase increases. This seems to be due to the fact that the γ-phase area ratio increases as the γ-phase volume fraction increases, resulting in decrease in brittle boundaries between the β-phase grains and increase in boundaries between the β-phase and the γ-phase. In the alloys $B_1$ and $C_1$ produced by the one-stage heat treatment, for instance, the mechanical strength increases from about 400 MPa to 780 MPa as the γ-phase volume fraction increases from 18% to 24%, apparently because the γ-phase area ratio increases from 40% to 65% between the alloys $B_1$ and $C_1$. It is clear from these results that at least 40% by area of the β-phase grain boundaries should be occupied by the γ-phase to achieve high mechanical strength.

Figure 2:
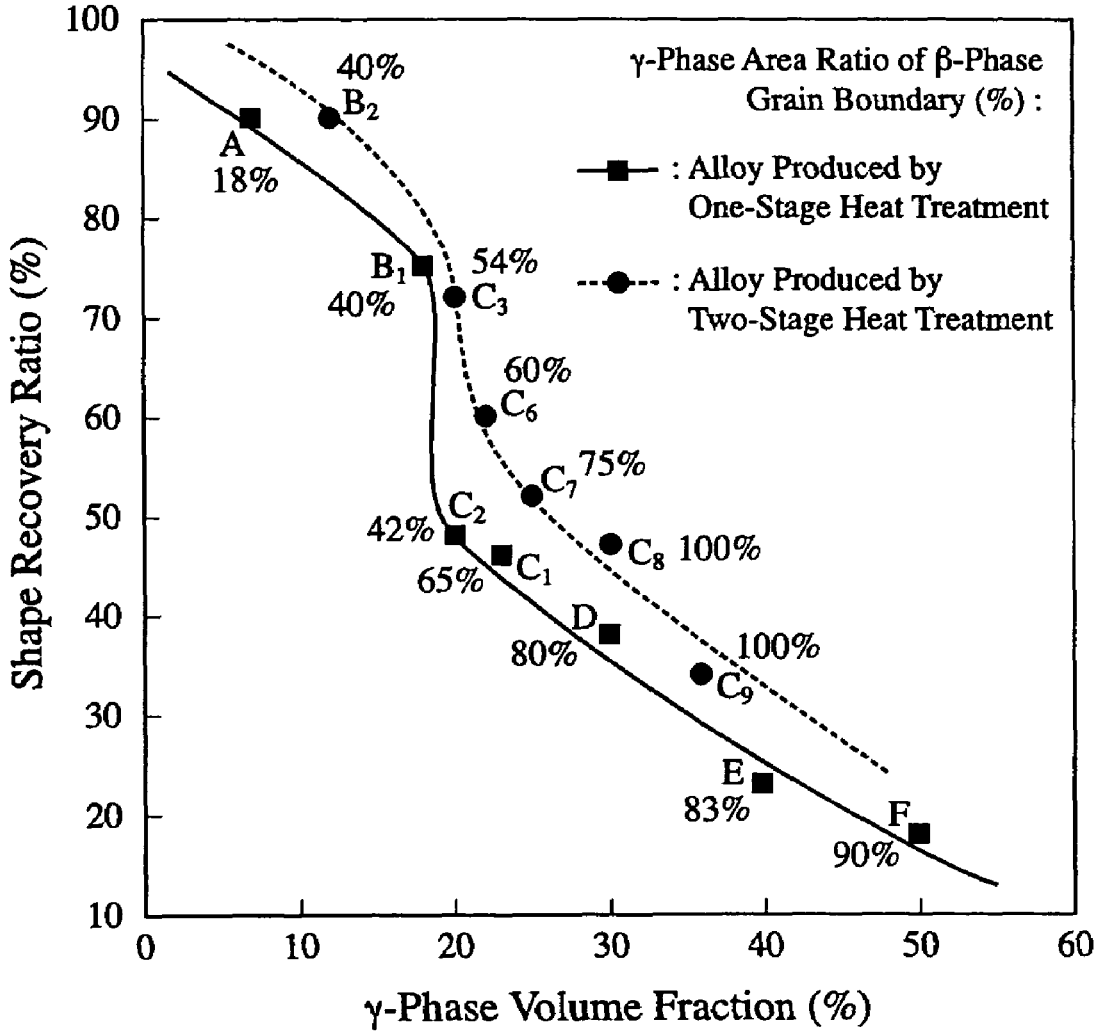
FIG. 2 is a graph showing the relation of a shape recovery ratio to a γ-phase volume fraction and a γ-phase area ratio in shape memory alloys produced by a one-stage heat treatment and a two-stage heat treatment, respectively.

FIG. 2 shows the relation of a shape recovery ratio to a γ-phase volume fraction and a γ-phase area ratio in the shape memory alloys produced by a one-stage heat treatment and a two-stage heat treatment, respectively. The shape recovery ratio of the Ni—Co—Al alloy depends on the area ratio and volume fraction of the γ-phase existing in the β-phase grain boundaries in any of the above heat treatments. The shape recovery ratio increases as the volume fraction or area ratio of the γ-phase decreases, and decreases as the volume fraction or area ratio of the γ-phase increases, apparently because larger irreversible permanent strain is introduced into the alloy when deformed as the volume fraction or area ratio of the γ-phase increases.

As shown in FIGS. 1 and 2, higher mechanical strength by increasing the area ratio or volume fraction of the γ-phase results in a lower shape recovery ratio, and a larger shape recovery ratio by decreasing the area ratio or volume fraction of the γ-phase results in lower mechanical strength. To achieve a satisfactory combination of mechanical strength and a shape recovery ratio, the γ-phase area ratio is preferably 40 to 100%, more preferably 45 to 80%, further preferably 50 to 70%, and the γ-phase volume fraction is preferably 5 to 50%, more preferably 18 to 40%, further preferably 20 to 30%.

The area ratio and volume fraction of the γ-phase existing in the β-phase grain boundaries can be controlled by adjusting the composition of the Ni—Co—Al alloy. The lower the Al content is in the shape memory alloy, the more γ-phase is generated. Thus, the lower Al content and the higher Co content provide the higher volume fraction and area ratio of the γ-phase existing in the β-phase grain boundaries. On the contrary, the higher Al content and the lower Co content provide the lower volume fraction and area ratio of the γ-phase existing in the β-phase grain boundaries.

The shape memory alloy preferably has an Al content of 30 atomic % or less and a Co content of 20 atomic % or more, such that the γphase area ratio is 40% or more. To obtain high mechanical strength and shape recovery ratio, the Ni—Co—Al alloy more preferably contains 22 to 30 atomic % of Al and 20 to 50 atomic % of Co.

Al affects the mechanical strength and shape recovery ratio of the alloy. The shape recovery ratio is insufficient when the Al content is less than 22 atomic %, and the mechanical strength is insufficient when the Al content is more than 30 atomic %. Thus, the Al content is preferably 22 to 30 atomic %. Co affects the mechanical strength and shape recovery ratio of the alloy. The mechanical strength is insufficient when the Co content is less than 20 atomic %, and the shape recovery ratio is insufficient when the Co content is more than 50 atomic %. Thus, the Co content is preferably 20 to 50 atomic %.

In a case where the shape memory alloy is ferromagnetic, the shape memory alloy should comprise 27 atomic % or less of Al and 39 atomic % or more of Co to achieve the γ-phase area ratio of 40% or more. To obtain high mechanical strength shape recovery ratio, the Ni—Co—Al alloy preferably contains 23 to 27 atomic % of Al and 39 to 45 atomic % of Co, the balance being 28 to 38 atomic % of Ni and inevitable impurities, etc.

The Ni—Co—Al alloy preferably contains 0.001 to 30 atomic % of Fe, 0.001 to 30 atomic % of Mn, 0.001 to 50 atomic % of Ga, 0.001 to 50 atomic % of In, 0.001 to 50 atomic % of Si, 0.0005 to 0.01 atomic % of B, 0.0005 to 0.01 atomic % of Mg, 0.0005 to 0.01 atomic % of C, and 0.0005 to 0.01 atomic % of P, in addition to Co, Ni and Al. Further, the shape memory alloy preferably contains 0.001 to 10 atomic % of at least one of Pt, Pd, Au, Ag, Nb, V, Ti, Cr, Zr, Cu, W and Mo, or 0.001 to 10 atomic % in total when they are combined.

Fe acts to enlarge a region of the β-phase having a B2 structure (so-called CsCl structure), and changes a martensitic transformation temperature, at which the matrix structure mainly composed of the β-phase having a B2 structure undergoes martensitic transformation, and a Curie temperature, at which the magnetic properties of the alloy change from paramagnetic to ferromagnetic. However, when the Fe content is less than 0.001 atomic %, the effect of enlarging the β-phase region having a B2 structure cannot be achieved. Even when the Fe content exceeds 30 atomic %, the effect of enlarging the β-phase region is saturated. Thus, the Fe content is preferably 0.001 to 30 atomic %.

Mn accelerates the formation of the β-phase having a B2 structure and changes the martensitic transformation temperature and the Curie temperature. However, when the Mn content is less than 0.001 atomic %, the effect of enlarging the β-phase region having a B2 structure cannot be achieved. Even when the Mn content exceeds 30 atomic %, the effect of enlarging the β-phase region is saturated. Thus, the Mn content is preferably 0.001 to 30 atomic %.

Ga changes the martensitic transformation temperature and the Curie temperature with In, Si, etc. Ga has a synergistic effect with In and Si to arbitrarily control the martensitic transformation temperature and the Curie temperature within a range of −200° C. to +200° C. However, when the Ga content is less than 0.001 atomic % or more than 50 atomic %, the effect of controlling the martensitic transformation temperature and the Curie temperature cannot be achieved. Thus, the Ga content is preferably 0.001 to 50 atomic %.

In changes the martensitic transformation temperature and the Curie temperature with Ga, Si, etc. In has a synergistic effect with Ga and Si to arbitrarily control the martensitic transformation temperature and the Curie temperature within a range of −200° C. to +200° C. However, when the In content is less than 0.001 atomic % or more than 50 atomic %, the effect of controlling the martensitic transformation temperature and the Curie temperature cannot be achieved. Thus, the In content is preferably 0.001 to 50 atomic %.

Si changes the martensitic transformation temperature and the Curie temperature with Ga, In, etc. Si has a synergistic effect with Ga and In to arbitrarily control the martensitic transformation temperature and the Curie temperature within a range of −200° C. to +200° C. However, when the Si content is less than 0.001 atomic % or more than 50 atomic %, the effect of controlling the martensitic transformation temperature and the Curie temperature cannot be achieved. Thus, the Si content is preferably 0.001 to 50 atomic %.

B makes the alloy structure finer with Mg, C, P, etc., thereby improving the ductility and shape memory properties of the alloy. However, when the B content is less than 0.0005 atomic %, the effect of forming a finer structure to improve the ductility cannot be achieved. Even when the B content exceeds 0.01 atomic %, the effect of forming a finer structure to improve the ductility is saturated. Thus, the B content is preferably 0.0005 to 0.01 atomic %.

Mg makes the alloy structure finer with B, C, P, etc., thereby improving the ductility and shape memory properties of the alloy. However, when the Mg content is less than 0.0005 atomic %, the effect of forming a finer structure to improve the ductility cannot be achieved. Even when the Mg content exceeds 0.01 atomic %, the effect of forming a finer structure to improve the ductility is saturated. Thus, the Mg content is preferably 0.0005 to 0.01 atomic %.

C makes the alloy structure finer with $B_1$ Mg, P, etc., thereby improving the ductility and shape memory properties of the alloy. However, when the C content is less than 0.0005 atomic %, the effect of forming a finer structure to improve the ductility cannot be achieved. Even when the C content exceeds 0.01 atomic %, the effect of forming a finer structure to improve the ductility is saturated. Thus, the C content is preferably 0.0005 to 0.01 atomic %.

P makes the alloy structure finer with B, Mg, C, etc., thereby improving the ductility and shape memory properties of the alloy. However, when the P content is less than 0.0005 atomic %, the effect of forming a finer structure to improve the ductility cannot be achieved. Even when the P content exceeds 0.01 atomic %, the effect of forming a finer structure to improve the ductility is saturated. Thus, the P content is preferably 0.0005 to 0.01 atomic %.

Pt, Pd, Au, Ag, Nb, V, Ti, Cr, Zr, Cu, W and Mo not only change the martensitic transformation temperature and the Curie temperature, but also make the alloy structure finer and improve the ductility of the alloy. However, when their content is less than 0.001 atomic %, the effect of forming a finer structure to improve the ductility cannot be achieved. Even when their content exceeds 10 atomic %, the effect of forming a finer structure to improve the ductility is saturated. Thus, their content is preferably 0.001 to 10 atomic % when one of them is added, and 0.001 to 10 atomic % in total when two or more of them are added.

Figure 3:
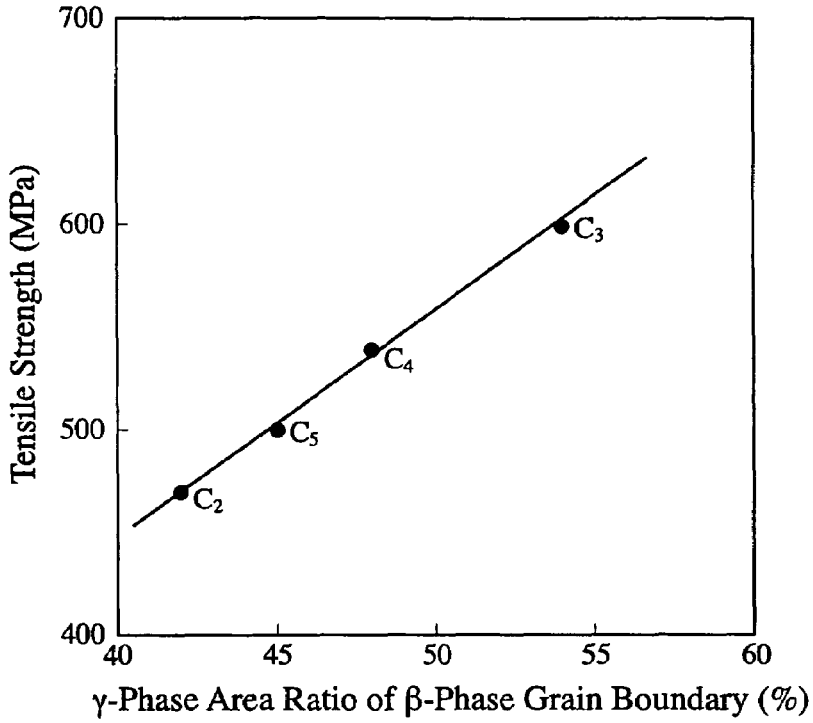
FIG. 3 is a graph showing the relation of mechanical strength (tensile strength) to a γ-phase area ratio at a constant γ-phase volume fraction in shape memory $Ni_{bal}Co_{41}Al_{26}$ alloys.

The mechanical strength and shape recovery ratio of the shape memory alloy can also be controlled by the heat treatment. FIG. 3 shows the relation of mechanical strength to a γ-phase area ratio at a constant γ-phase volume fraction in shape memory $Ni_{bal}Co_{41}Al_{26}$ alloys. As shown in FIG. 3, the mechanical strength becomes higher as the γ-phase area ratio increases at a constant γ-phase volume fraction. It is preferable to conduct the two-stage heat treatment to increase the γ-phase area ratio without changing the γ-phase volume fraction. As shown in FIG. 3, for instance, the shape memory alloys $C_3$, $C_4$ and $C_5$ produced by the two-stage heat treatment have higher γ-phase area ratios and higher mechanical strength than the shape memory alloy $C_2$ produced by the one-stage heat treatment. Further, as shown in FIG. 1, the shape memory alloys produced by the two-stage heat treatment have higher γ-phase area ratios and higher mechanical strength than the shape memory alloys with the same γ-phase volume fractions produced by the one-stage heat treatment.

Figure 4:
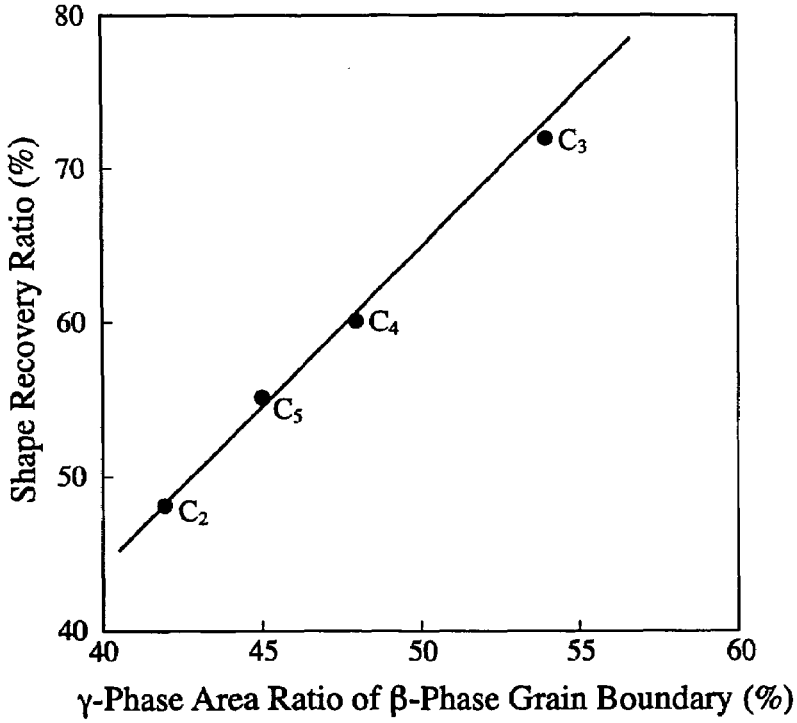
FIG. 4 is a graph showing the relation of a shape recovery ratio to a γ-phase area ratio at a constant γ-phase volume fraction in shape memory $Ni_{bal}Co_{41}Al_{26}$ alloys.

FIG. 4 shows the relation of a shape recovery ratio to a γ-phase area ratio at a constant γ-phase volume fraction in shape memory $Ni_{bal}Co_{41}Al_{26}$ alloys. As shown in FIG. 4, the shape recovery ratio becomes higher as the γ-phase area ratio increases at a constant γ-phase volume fraction. As shown in FIG. 4, the shape memory alloys $C_3$, $C_4$, and $C_5$ produced by the two-stage heat treatment have higher γ-phase area ratios and higher shape recovery ratio than the shape memory alloy $C_2$ produced by the one-stage heat treatment.

As described above, the two-stage heat treatment can increase the γphase area ratio without changing the γ-phase volume fraction, thereby providing the shape memory alloy with improved mechanical strength and shape recovery ratio.

A preferred example of the production of the shape memory alloy of the present invention will be described below. First, an alloy having a predetermined composition is formed into an ingot by a melting method. The ingot is subjected to one heat treatment step or two or more heat treatment steps to produce a shape memory alloy having a two-phase structure comprising a β-phase having a B2 structure and a γ-phase having an fcc structure. For example, in the case of the one-stage heat treatment, the two-phase structure comprising a β-phase and a γ-phase may be formed by heating the alloy at 1000 to 1350° C. for 0.5 to 50 hours, and by cooling the alloy at 10 to 10000° C./minute. In the case of the two-stage heat treatment, the two-phase structure may be formed by a first heat treatment step comprising heating the alloy at 1200 to 1350° C. for 0.1 to 50 hours and cooling the alloy at 0.1 to 1000° C./minute, and a second heat treatment step comprising heating the alloy at 1000 to 1320° C. for 0.1 to 50 hours and cooling the alloy at 10 to 10000° C./minute. The resultant shape memory alloy may be formed into a desired shape such as a plate and a wire by hot rolling, etc.

In the two-stage heat treatment, the γ-phase area ratio can be increased without changing the γ-phase volume fraction by selecting the desired heat treatment conditions to improve the mechanical strength and shape recovery ratio of the alloy. For this purpose, the alloy is preferably heated at 1300 to 1350° C. for 0.1 to 10 hours in the first heat treatment step, and heated at 1000 to 1320° C. for 0.1 to 10 hours in the second heat treatment step. More preferably, the alloy is heated at 1300 to 1350° C. for 0.1 to 1 hour in the first heat treatment step, and then heated at 1000 to 1320° C. for 0.1 to 5 hours in the second heat treatment step. The alloy may be subjected to cold or hot rolling in either heat treatment step.

The present invention will be described in more detail below with reference to Examples without intention of restricting the scope of the invention.

EXAMPLE 1

(1) Production of Shape Memory Alloy 300 g of a $Ni_{bal}Co_{44}Al_{23}$ alloy (by atomic %) was melted by a high-frequency furnace, and cast to an ingot using a mold having an inside diameter of 20 mm. The ingot was hot-rolled at 1300° C. into a plate having a thickness of about 2 mm, which was cut into a ribbon of 2 mm wide and 20 mm long. The ribbon was heat-treated at 1300° C. for 1 hour and cooled at 10000° C./minute to produce a ferromagnetic shape memory alloy F having a two-phase structure containing a β-phase having a B2 structure and a γ-phase having an fcc structure. The composition, heat treatment conditions, γ-phase volume fraction, and γ-phase area ratio of the shape memory alloy F are shown in Table 1.

(2) Shape Recovery Test

The ribbon of 2 mm wide and 20 mm long cut from the hot-rolled plate was wet-polished to a thickness of 0.15 mm, and placed in a transparent silica tube filled with an argon gas. The ribbon was heat-treated at 1300° C. for 1 hour and cooled at 10000° C./minute to prepare a bending test sample. The sample was wound around a cylinder at a temperature near Ms to give 2% strain to its surface, and the radius of curvature of the strained sample was measured. The sample was then placed in an electric furnace at 200° C. to recover the original shape, and the radius of curvature of the sample was measured.

Surface strain ϵ was determined with respect to the strained sample and the shape-recovered sample, respectively, by the following formula (1):

$$\epsilon=(d/2r)\times 100(\%) \quad (1),$$

wherein d is the thickness of the sample, and r is the radius of curvature of the sample.

The shape recovery ratio ΔS of the sample was then calculated by the following formula (2):

$$\Delta S=(\epsilon_d-\epsilon_r)\times 100/\epsilon_d(\%) \quad (2),$$

wherein $\epsilon_d$ is a surface strain of the strained sample, and $\epsilon_r$ is a surface strain of the shape-recovered sample. The shape recovery ratio is shown in Table 1 and FIG. 2.

(3) Tensile Test

The hot-rolled plate produced in (1) was cut into a ribbon by electrodischarge, and the ribbon was heat-treated in the same manner as in (2) and wet-polished to prepare a 1.2-mm-thick sample. The tensile strength of the sample was measured at room temperature at a crosshead speed of 0.5 mm/minute. The results are shown in Table 1 and FIG. 1.

(4) γ-Phase Volume Fraction

The composition of the shape memory alloy produced in (1) was analyzed by SEM-EDX, and the γ-phase volume fraction was determined from the composition of the β-phase and the γ-phase using a lever relation. The results are shown in Table 1 and FIGS. 1 and 2.

(5) γ-Phase Area Ratio of β-Phase Grain Boundaries

A cross section of the shape memory alloy produced in (1) was observed by an optical microscope. Pluralities of the β-phase grain boundaries in the cross section were measured with respect to length, to determine the length of the γ-phase in each β-phase grain boundary. The γ-phase area ratio A in the β-phase grain boundaries was calculated by the following formula (3):

$$A=(L_\gamma/L_\beta)\times 100(\%) \quad (3),$$

wherein $L_\beta$ is the total length of the β-phase grain boundaries, and $L_\gamma$ is the total length of the γ-phase grains in the β-phase grain boundaries. The results are shown in Table 1 and FIGS. 1 and 2.

EXAMPLES 2 to 6

Figure 5:
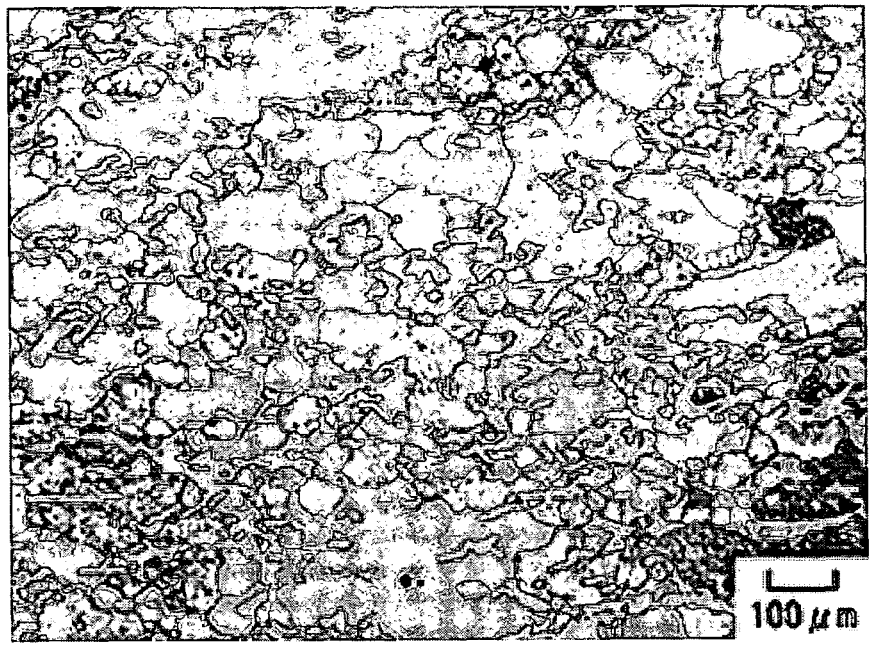
FIG. 5 is a photomicrograph showing a cross section of a shape memory alloy with a γ-phase area ratio of 65% produced by one-stage heat treatment in Example 4.

Ferromagnetic shape memory alloys $B_1$, $C_1$, $C_2$, D and E each having a two-phase structure comprising a shape memory β (B2) phase and a γ-phase were produced in the same manner as in Example 1 except for using alloys of $Ni_{bal}Co_{39.5}Al_{27}$, $Ni_{bal}Co_{41}Al_{26}$, $Ni_{bal}Co_{42}Al_{25}$ and $Ni_{bal}Co_{43}Al_{24}$ as starting materials. The resultant shape memory alloys were evaluated in the same manner as in Example 1. The composition, heat treatment conditions, γ-phase volume fraction, γ-phase area ratio, shape recovery ratio and tensile strength of each shape memory alloy are shown in Table 1 and FIGS. 1 and 2. A photomicrograph of a cross section of the ferromagnetic shape memory alloy $C_1$ is shown in FIG. 5.

EXAMPLE 7

A $Ni_{bal}Co_{41}Al_{26}$ alloy was melted and cast to an ingot using a mold having an inside diameter of 20 mm. The ingot was hot-rolled at 1300° C. into a plate having a thickness of about 2 mm, and the plate was cut into a ribbon of 2 mm wide and 20 mm long. The ribbon was heat-treated by two stages at 1350° C. for 0.5 hours and then at 1320° C. for 1 hour, and cooled at 10000° C./minute, to produce a ferromagnetic shape memory alloy $C_3$ having a two-phase structure containing a β-phase having a B2 structure and a γ-phase having an fcc structure. The ferromagnetic shape memory alloy $C_3$ was evaluated in the same manner as in Example 1. The composition, heat treatment conditions, γ-phase volume fraction, γ-phase area ratio, shape recovery ratio and tensile strength of the ferromagnetic shape memory alloy $C_3$ are shown in Table 1 and FIGS. 1 to 4.

EXAMPLE 8

A ferromagnetic shape memory alloy $C_4$ having a two-phase structure containing a β-phase having a B2 structure and a γ-phase having an fcc structure was produced in the same manner as in Example 7, except that the ribbon was heat-treated by two stages at 1350° C. for 0.5 hours and then at 1320° C. for 5 hours. The ferromagnetic shape memory alloy $C_4$ was evaluated in the same manner as in Example 7. The results are shown in Table 1 and FIGS. 1 to 4.

EXAMPLE 9

A ferromagnetic shape memory alloy $C_5$ having a two-phase structure containing a β-phase having a B2 structure and a γ-phase having an fcc structure was produced in the same manner as in Example 7, except that the ribbon was heat-treated by two stages at 1350° C. for 0.5 hours and then at 1320° C. for 10 hours. The ferromagnetic shape memory alloy $C_5$ was evaluated in the same manner as in Example 7. The results are shown in Table 1.

EXAMPLE 10

A ferromagnetic shape memory alloy $C_6$ having a two-phase structure containing a β-phase having a B2 structure and a γ-phase having an fcc structure was produced in the same manner as in Example 7, except that the ribbon was heat-treated by two stages at 1350° C. for 0.5 hours and then at 1300° C. for 1 hour. The ferromagnetic shape memory alloy $C_6$ was evaluated in the same manner as in Example 7. The results are shown in Table 1 and FIGS. 1 and 2.

EXAMPLE 11

A ferromagnetic shape memory alloy $C_7$ having a two-phase structure containing a β-phase having a B2 structure and a γ-phase having an fcc structure was produced in the same manner as in Example 7, except that the ribbon was heat-treated by two stages at 1350° C. for 0.5 hours and then at 1200° C. for 2 hours. The ferromagnetic shape memory alloy $C_7$ was evaluated in the same manner as in Example 7. The results are shown in Table 1 and FIGS. 1 and 2.

EXAMPLE 12

Figure 6:
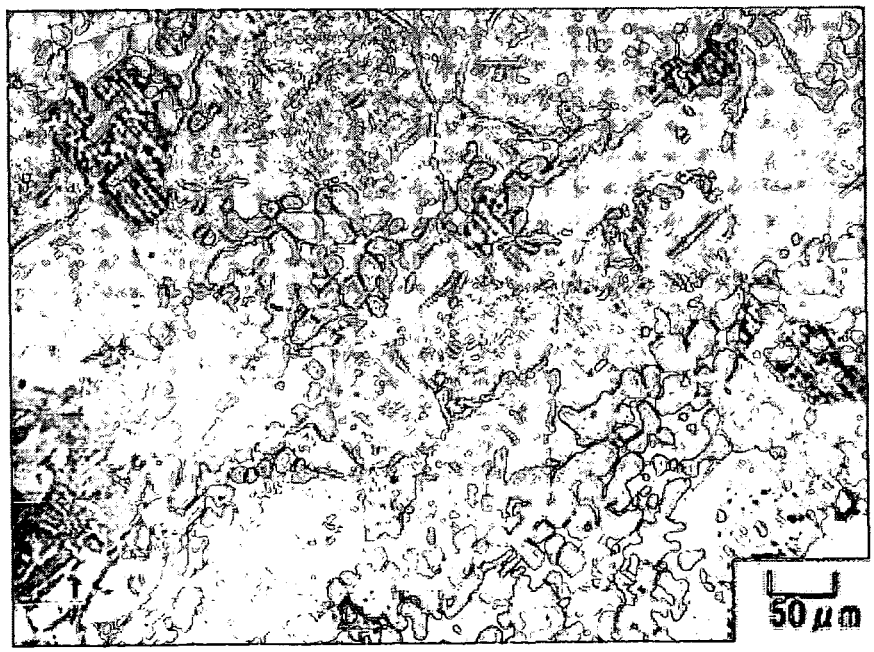
FIG. 6 is a photomicrograph showing a cross section of a shape memory alloy with a γ-phase area ratio of 100% produced by two-stage heat treatment in Example 12.

A ferromagnetic shape memory alloy $C_8$ having a two-phase structure containing a β-phase having a B2 structure and a γ-phase having an fcc structure was produced in the same manner as in Example 7, except that the ribbon was heat-treated by two stages at 1350° C. for 0.5 hours and then at 1100° C. for 4 hours. The ferromagnetic shape memory alloy $C_8$ was evaluated in the same manner as in Example 7. The results are shown in Table 1 and FIGS. 1 and 2. A photomicrograph of a cross section of the ferromagnetic shape memory alloy $C_8$ is shown in FIG. 6.

EXAMPLE 13

A ferromagnetic shape memory alloy $C_9$ having a two-phase structure containing a β-phase having a B2 structure and a γ-phase having an fcc structure was produced in the same manner as in Example 7, except that the ribbon was heat-treated by two stages at 1350° C. for 0.5 hours and then at 1000° C. for 5 hours. The ferromagnetic shape memory alloy $C_9$ was evaluated in the same manner as in Example 7. The results are shown in Table 1 and FIGS. 1 and 2.

EXAMPLE 14

A ferromagnetic shape memory alloy $B_2$ having a two-phase structure containing a β-phase having a B2 structure and a γ-phase having an fcc structure was produced in the same manner as in Example 7, except that a $Ni_{bal}CO_{39.5}Al_{27}$ alloy was used as a starting material, and that the ribbon was heat-treated by two stages at 1350° C. for 0.5 hours and then at 1300° C. for 1 hour. The ferromagnetic shape memory alloy $B_2$ was evaluated in the same manner as in Example 7. The results are shown in Table 1 and FIGS. 1 and 2.

COMPARATIVE EXAMPLE 1

A ferromagnetic shape memory alloy A having a two-phase structure containing a β-phase having a B2 structure and a γ-phase having an fcc structure was produced in the same manner as in Example 1 except for using a $Ni_{bal}Co_{38.5}Al_{28}$ alloy as a starting material. The composition, heat treatment conditions, γ-phase volume fraction, γ-phase area ratio, shape recovery ratio and tensile strength of the shape memory alloy A are shown in Table 1 and FIGS. 1 and 2.

TABLE 1

| No. | Alloy | Heat treatment Conditions (° C./hour) | γ-Phase Area Ratio (%) | γ-Phase Volume Fraction (%) |
|---|---|---|---|---|
| Example 1 | F | 1300/1 | 90 | 50 |
| Example 2 | E | 1300/1 | 83 | 40 |
| Example 3 | D | 1300/1 | 80 | 30 |
| Example 4 | $C_1$ | 1280/1 | 65 | 24 |
| Example 5 | $C_2$ | 1320/1 | 42 | 20 |
| Example 6 | $B_1$ | 1250/1 | 40 | 18 |
| Example 7 | $C_3$ | 1350/0.5 + 1320/1 | 54 | 20 |
| Example 8 | $C_4$ | 1350/0.5 + 1320/5 | 48 | 20 |
| Example 9 | $C_5$ | 1350/0.5 + 1320/10 | 45 | 20 |
| Example 10 | $C_6$ | 1350/0.5 + 1300/1 | 60 | 22 |
| Example 11 | $C_7$ | 1350/0.5 + 1200/2 | 75 | 25 |
| Example 12 | $C_8$ | 1350/0.5 + 1100/4 | 100 | 30 |
| Example 13 | $C_9$ | 1350/0.5 + 1000/5 | 100 | 36 |
| Example 14 | $B_2$ | 1350/0.5 + 1300/1 | 40 | 12 |
| Comparative Example 1 | A | 1260/1 | 18 | 7 |

| No. | Shape Recovery Ratio (%) | Tensile Strength (MPa) | Alloy Composition (at. %) Al | Co | Ni(1) |
|---|---|---|---|---|---|
| Example 1 | 18 | 1000 | 23 | 44 | 33 |
| Example 2 | 23 | 1000 | 24 | 43 | 33 |
| Example 3 | 38 | 950 | 25 | 42 | 33 |
| Example 4 | 46 | 780 | 26 | 41 | 33 |
| Example 5 | 48 | 470 | 26 | 41 | 33 |
| Example 6 | 75 | 400 | 27 | 39.5 | 33.5 |
| Example 7 | 72 | 600 | 26 | 41 | 33 |

TABLE 1-continued

| | | | | | |
|---|---|---|---|---|---|
| Example 8 | 60 | 540 | 26 | 41 | 33 |
| Example 9 | 55 | 500 | 26 | 41 | 33 |
| Example 10 | 60 | 750 | 26 | 41 | 33 |
| Example 11 | 52 | 900 | 26 | 41 | 33 |
| Example 12 | 47 | 1050 | 26 | 41 | 33 |
| Example 13 | 34 | 1100 | 26 | 41 | 33 |
| Example 14 | 90 | 400 | 27 | 39.5 | 33.5 |
| Comparative Example 1 | 90 | 220 | 28 | 38.5 | 33.5 |

(1)Ni and inevitable impurities.

EVALUATION

As shown in Table 1, each of the ferromagnetic shape memory alloys $B_1$ to F of Examples 1 to 6, in which 40 to 90% by area of the β-phase grain boundaries were occupied by the γ-phase, showed excellent shape recovery ratios of 18 to 75% and tensile strengths of 400 to 1000 MPa, higher than that of the ferromagnetic shape memory alloy A of Comparative Example 1, in which 18% by area of the β-phase grain boundaries were occupied by the γ-phase. With respect to the alloys having the same composition of $Ni_{bal}Co_{41}Al_{26}$ and the same γ-phase volume fraction, the comparison of the shape memory alloys of Examples 7 to 9 produced by the two-stage heat treatment with that of Example 5 produced by the one-stage heat treatment revealed that the two-stage heat treatment increased the γ-phase area ratio, thereby improving the mechanical strength and the shape recovery ratio.

As described above, the shape memory alloy of the present invention is a Ni—Co—Al alloy having a two-phase structure comprising a phase and a γ-phase, at least 40% by area of the βphase grain boundaries being occupied by the γ-phase. Accordingly, the shape memory alloy of the present invention has high mechanical strength, and excellent workability and shape recovery ratio, useful for actuators.

What is claimed is:

1. A shape memory alloy comprising Co, Ni and Al, wherein said shape memory alloy has a two-phase structure comprising a β-phase having a B2 structure and a γ-phase having an fcc structure, at least 40% by area of crystal grain boundaries of said β-phase being occupied by said γ-phase and the fraction of said γ-phase volume in said shape memory alloy being 5 to 50% by volume, wherein said alloy contains 23 to 27 atomic % of Al and 39 to 45 atomic % of Co, the balance being 28 to 38 atomic % of Ni and inevitable impurities, and wherein said alloy has a tensile strength of about 400-1100 MPa and a shape recovery of 18% or more.

2. The shape memory alloy according to claim 1, wherein 45 to 80% by area of said crystal grain boundaries of said β-phase are occupied by said γ-phase.

3. The shape memory alloy according to claim 1, wherein said at least 40% by area of crystal grain boundaries is created by a one-stage heat treatment of said shape memory alloy comprising a heat treatment step comprising heating at 1000 to 1350° C. for 0.5 to 50 hours and cooling at 10 to 10000° C./minute.

4. The shape memory alloy according to claim 1, wherein said at least 40% by area of crystal grain boundaries is created by a two-stage heat treatment of said shape memory alloy comprising a first heat treatment step comprising heating at 1200 to 1350° C. for 0.1 to 50 hours and cooling at 0.1 to 1000° C./minute, and a second heat treatment step comprising heating at 1000 to 1320° C. for 0.1 to 50 hours and cooling at 10 to 10000° C./minute.

5. The shape memory alloy according to claim 4, wherein said first heat treatment step comprises heating at 1350° C. for 0.5 hours.

* * * * *